United States Patent [19]

Wiseman et al.

[11] Patent Number: 4,747,504

[45] Date of Patent: May 31, 1988

[54] AIRCRAFT CARGO CONTAINER

[75] Inventors: Albert D. Wiseman; Bernard J. Roke; John M. Kachman; Gregg A. Delker; William F. Corcoran, all of Wilmington, Ohio; Phillip A. Boshaw, Redmond, Wash.; Gordon J. Sanden, Jr., Huntington Beach, Calif.

[73] Assignee: Airborne Express, Inc., Wilmington, Ohio

[21] Appl. No.: 870,815

[22] Filed: Jun. 5, 1986

[51] Int. Cl.[4] ..... B65D 87/00

[52] U.S. Cl. ..... 220/1.5

[58] Field of Search ..... 220/1.5

[56] References Cited

U.S. PATENT DOCUMENTS

| | | | |
|---|---|---|---|
| 3,294,034 | 12/1966 | Bodenheimer et al. | 220/1.5 X |
| 3,598,273 | 8/1971 | Rau et al. | 220/1.5 |
| 3,692,203 | 9/1972 | Byrd et al. | 220/1.5 |
| 3,706,392 | 12/1972 | Sprick et al. | 220/1.5 X |
| 3,853,239 | 12/1974 | Meller et al. | 220/1.5 |
| 3,854,544 | 12/1974 | Kolchev | 220/1.5 X |
| 3,904,064 | 9/1975 | Looker | 220/1.5 |
| 3,915,327 | 10/1975 | Loyich et al. | 220/1.5 |
| 3,972,437 | 8/1976 | Loyich et al. | 220/1.5 |
| 4,046,277 | 9/1977 | Morrison | 220/1.5 |
| 4,428,491 | 1/1984 | Mittelmann et al. | 220/1.5 |

*Primary Examiner*—Steven M. Pollard

*Attorney, Agent, or Firm*—Vorys, Sater, Seymour & Pease

[57] ABSTRACT

An aircraft cargo container having sides, inboard and outboard ends, a horizontal top and a horizontal bottom. The bottom is rectangular and provided with casters located in corner recesses. The inboard end and both sides of the container are substantially vertical, while the outboard end substantially conforms to the curvature of the aircraft fuselage cabin cross section. The inboard and outboard ends are so sized that the container will freely pass through a standard left side passenger entry door. The sides are so dimensioned that when two containers are located end-to-end with their inboard ends opposed, they will substantially fill the aircraft fuselage cabin cross section with clearance between themselves and between themselves and the aircraft fuselage, so that a plurality of containers can be arranged within the aircraft in two longitudinal rows, the containers of each row having adjacent sides opposed. Each container has a door in one of its sides. The container bottom provides flanges along the container ends cooperating with side guide rails and a center guide rail assembly mounted in the aircraft. The container bottom also provides flanges along the container sides, engageable by fore and aft restraints.

14 Claims, 10 Drawing Sheets

A
B

AIRCRAFT CARGO CONTAINER

TECHNICAL FIELD

The invention relates to aircraft cargo containers, and more particularly to such containers requiring approximately one-sixth the floor space of a conventional pallet or container, capable of being loaded through a standard passenger entry door, and being arrangeable in two longitudinal rows within the aircraft.

BACKGROUND ART

In the usual practice, aircraft are built in passenger carrying versions and cargo carrying versions. Cargo carrying versions differ from passenger carrying versions in that the interiors are not provided with seats and other appurtences characteristic of passenger carrying aircraft. Cargo carrying aircraft are also provided with oversize cargo loading doors. A net or barrier, capable of withstanding 9 g loading, is located between the cargo area and the crew cabin.

In the usual practice, cargo is loaded on large pallets or in large containers (frequently referred to as "igloos"). The pallets or containers extend substantially the full width of the cargo aircraft fuselage and are arranged within the aircraft in a single longitudinal row. Heavy equipment is required to manuever the pallets or containers on the ground and into and out of the aircraft.

It is often desirable to convert a passenger carrying aircraft to a cargo carrying aircraft. While such conversion is relatively easy, such converted passenger aircraft are not provided with oversize cargo doors and, therefore, conventional pallets or containers cannot be used. Frequently, in such instances, hampers are used, not unlike laundry hampers. Nevertheless, these hampers are less desirable and less efficient than the more conventional pallets or containers.

The present invention is directed to a container which can be used in either a conventional cargo aircraft, or a passenger aircraft converted for cargo carrying. The container of the present invention requires approximately one-sixth the floor space required for conventional containers or pallets and are arrangeable in the converted or standard cargo carrying aircraft in two parallel, longitudinally extending rows. The containers are so sized as to pass freely through the standard passenger entry door and are provided with casters so that they can be easily maneuvered on the ground and within the aircraft. The containers interact with a novel rail guide system easily mountable in the aircraft and can be restrained fore and aft by conventional rigid and retractable restraints.

The containers are identical, having vertical sides, a vertical inboard end and a curved outboard end adapted to conform to the curved cross sectional configuration of the aircraft fuselage cabin. Each container is provided with a door which may be fully opened, or, alternatively, only the upper portion can be opened. Less ground equipment and lighter ground equipment is required for handling of the containers on the ground and during loading and unloading procedures. More cargo can be located in fewer containers. Since the containers are smaller than the more conventional container or pallet, an individual container can be dedicated to a specific destination, frequently not possible with the use of the conventional large pallets or containers.

DISCLOSURE OF THE INVENTION

According to the invention, there are provided aircraft cargo containers. Each container comprises a bottom rectangular frame supporting recessed casters and a floor. Affixed to the bottom frame is a body comprising sides, ends and a substantially horizontal top. The inboard end of each container, as well as its sides, are substantially vertical. The outboard end of the container is curved to match the curvature of the aircraft fuselage cabin sidewalls. The containers may be identical and each is provided with an access door in one of its sides. The upper portion of the door may be opened, or the entire door may be opened, as desired. The door slides vertically and is provided with latch means.

The inboard and outboard ends of each container are so sized that the container will freely pass through a standard passenger entry door. The sides are so dimensioned that when two containers are located end-to-end with their inboard ends opposed, they will substantially fill the aircraft fuselage cabins cross section with clearance between themselves and themselves and the aircraft fuselage. As a result, a plurality of containers can be arranged within an aircraft in two longitudinal rows.

A side guide rail is mounted near the floor of the aircraft along each of the aircraft cabin sides. A longitudinal center rail assembly is also provided. The bottom frame of each container provides flanges along the bottom of the container ends adapted to cooperate with one of the side guide rails and with the center rail assembly. The bottom frame of each container also provides flanges at the bottom of the container sides, engageable by standard fore and aft restraints.

DETAILED DESCRIPTION OF THE INVENTION

Figure 1:
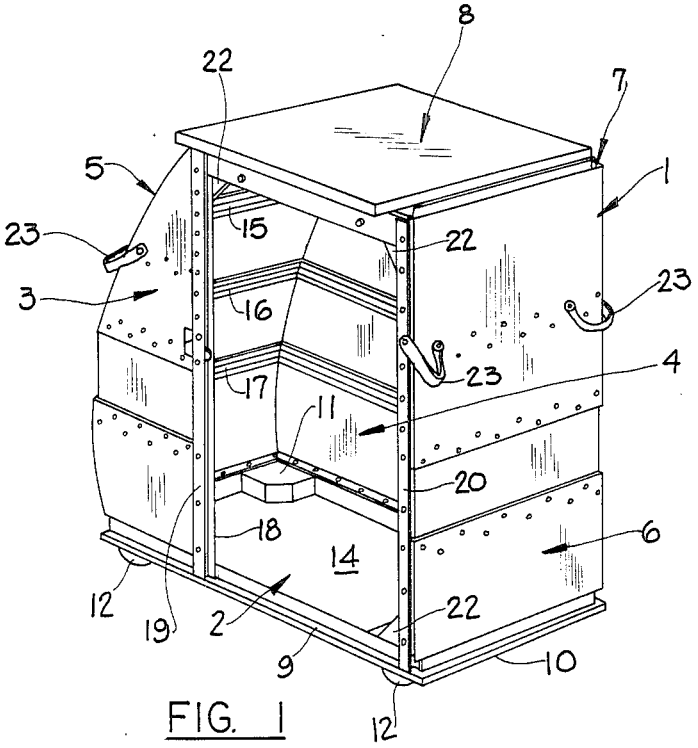
FIG. 1 is a perspective view of a container of the present invention, with its door in its fully open position.

Reference is first made to FIGS. 1–5, wherein like parts have been given like index numerals. These figures illustrate the container of the present invention. The container is generally indicated at 1. The container comprises a base generally indicated at 2, a door side generally indicated at 3, a non-door side generally indicated at 4, an outboard end generally indicated at 5, an inboard end generally indicated at 6, and a top generally indicated at 7. The container is provided with a door, generally indicated 8.

The base 2 comprises a rectangular aluminum frame 9. The frame 9 is provided with an integral peripheral flange 10 which extends along sides 3 and 4 and ends 5 and 6. The purpose of flange 10 will be apparent hereinafter. The aluminum frame 9 also provides a housing 11 in each corner (see also FIGS. 15 and 17) in which casters 12 are mounted in recessed fashion. Casters 12 are swivel mounted as at 13 (FIG. 15) and preferably have roller bearings in their wheels and ball bearings in their swivel mounts or casters.

The frame 9 also supports a floor 14. The floor 14 may be made of any appropriate material. Excellent results have been achieved with a floor comprising a balsa wood core sealed against moisture in a fiberglass skin. The floor 14 may be provided with drain holes (not shown). Finally, the bottom surface of base structure 2 is preferably given a rough texture to insure friction between it and the equipment used for handling, loading and unloading the container.

The frame 9 supports the body of container 1 comprising sides 3 and 4, ends 5 and 6 and the top 7. While the body may be made up of any appropriate light weight and sufficiently strong material such as aluminum or the like, it is preferred that the body be molded of flexible plastic material. The sides 3 and 4, and the ends 5 and 6 may be reinforced by aluminum ribs 15, 16, and 17, riveted or otherwise appropriately affixed to the inside surfaces thereof.

It will be noted from FIGS. 1–5 that the sides 3 and 4 and the inboard end 6 are substantially vertical, while the outboard end 5 is curved. The outboard end 5 is configured to correspond in curvature to the inside surface of the aircraft fuselage cabin sidewall. The top 7 of the container is substantially horizontal.

Figure 2:
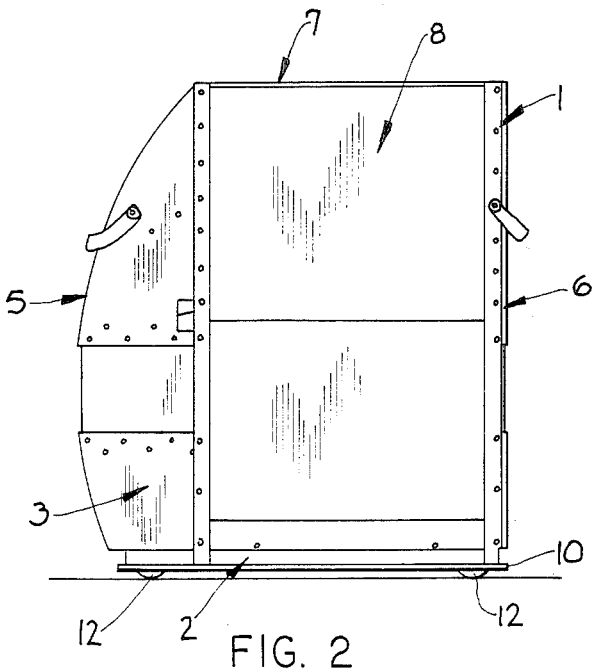
FIG. 2 is an elevational view of that side of the container of FIG. 1 provided with the door, the door being shown in its fully closed position.
Figure 4:
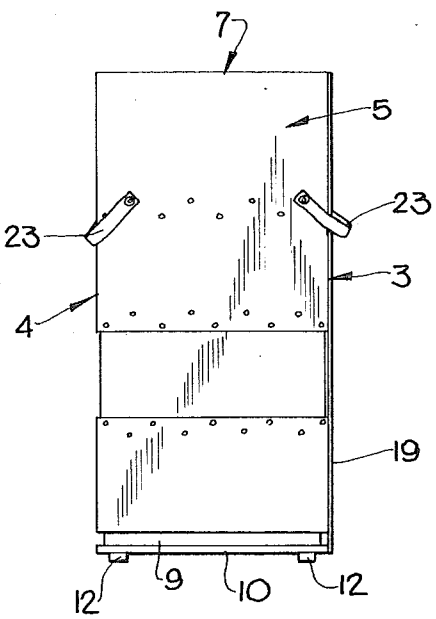
FIG. 4 is an elevational view of the outboard end of the container of FIG. 3, as viewed from the right of FIG. 3.
Figure 3:
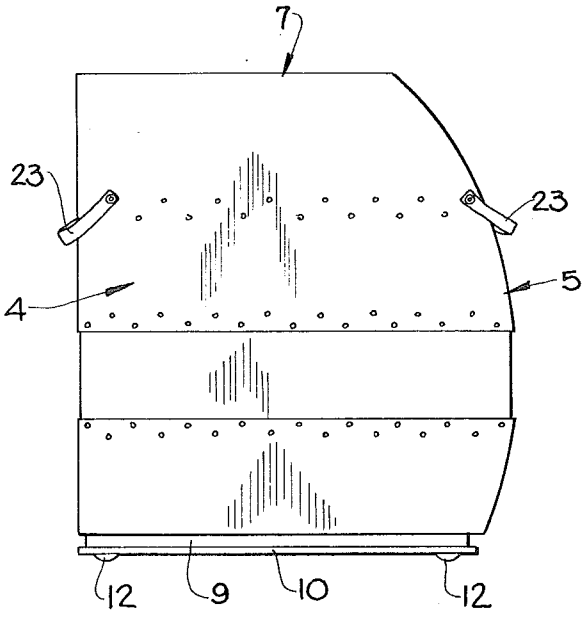
FIG. 3 is a side elevational view of the container, illustrating that side without the door.
Figure 5:
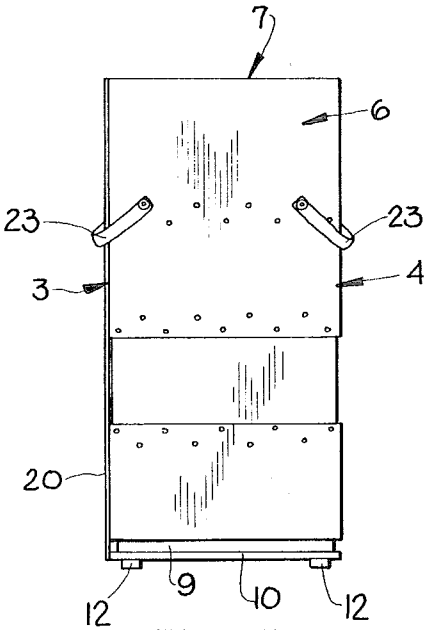
FIG. 5 is an elevational view of the inboard end of the container of FIG. 3, as seen from the left of FIG. 3.

As is most clearly seen in FIGS. 1 and 2, the side 3 of the container 1 is provided with a rectangular access or loading opening 18. The vertical edges of opening 18 are provided with channel members 19 and 20. Channel members 19 and 20 may be identical and are of an H-shaped cross section, as can be clearly seen in FIG. 13. The channels 19 and 20 are preferably made of aluminum.

Along the upper edge of opening 18 there is an aluminum reinforcing member 21 extending between channels 19 and 20. The channels 19 and 20 together with reinforcing member 21 are riveted or otherwise appropriately attached to side 3. Additional reinforcing gussets may be provided, as indicated at 22 in FIG. 1. The door 8 is slidably mounted in channels 19 and 20, as will be described hereinafter.

The container 1 is completed by the provision of hand holds or straps 23 on each of its four corners. The straps are located at a height suitable for use by a cargo loader to maneuver the container on the ground and in the aircraft.

Figure 6A:
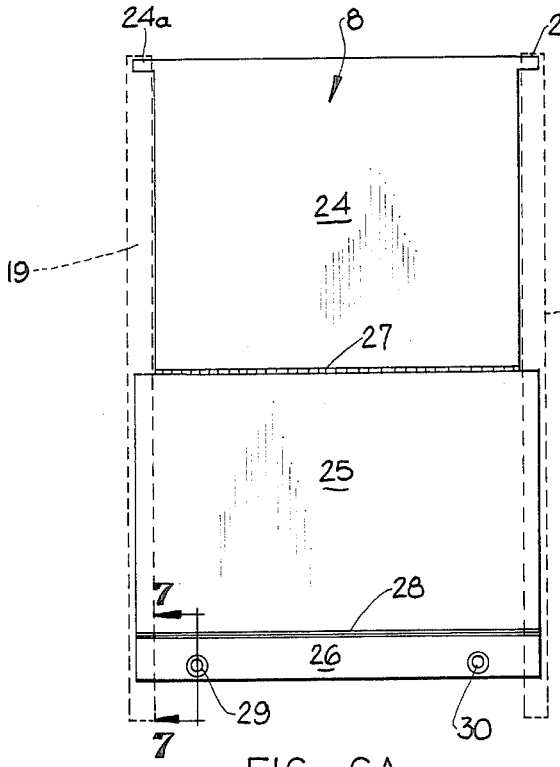
FIG. 6A is a front elevational view of the container door.
Figure 6B:
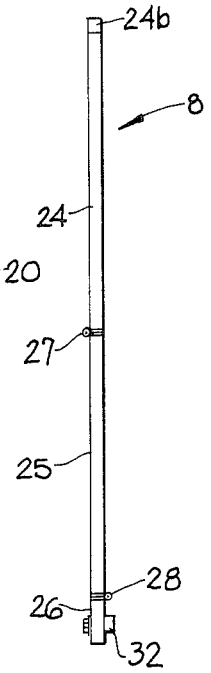
FIG. 6B is a side elevational view of the door of FIG. 6A as viewed from the right of FIG. 6A.

The door 8 of container 1 is most clearly illustrated in FIGS. 6A and 6B. The door 8 comprises an upper panel 24, an intermediate panel 25 and a lower panel 26. The lower edge of upper panel 24 is hingedly affixed to the upper edge of intermediate panel 25 by a piano-type hinge 27. Similarly, the lower edge of intermediate panel 25 is hingedly affixed to the upper edge of lower panel 26 by a piano-type hinge 28. It will be noted that hinges 27 and 28 (see FIG. 6B) are located on opposite sides of the door 8.

Intermediate panel 25 and lower panel 26 are of the same width. The width of panels 25 and 26 is such that their vertical edges are received in channels 19 and 20 with a sliding fit. It will be noted from FIG. 6A that upper panel 24 is narrower than intermediate panel 25 and lower panel 26. The width of panel 24 being slightly less than the distance between channels 19 and 20. At its uppermost end, upper panel 24 is provided with laterally extending lugs 24*a* and 24*b* which are slidingly engaged in channels 19 and 20.

Figure 7:
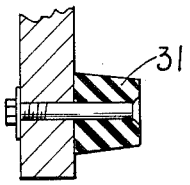
FIG. 7 is a fragmentary cross sectional view taken along section line 7—7 of FIG. 6A.

As can be seen from FIGS. 6A, 6B and 7 the lower panel 26, near its lower edge is provided with a pair of bolts 29 and 30. As is shown in FIG. 7, the bolt 29 mounts a rubber stop 31 on the inside surface of lower panel 26. In similar fashion, bolt 30 mounts a rubber stop 32. The purpose of stops 29 and 30 will be apparent hereinafter.

Door panels 24, 25 and 26 can be made of any appropriate material characterized by sufficient strength and being relatively lightweight. Excellent results have been achieved fabricating panels 24, 25 and 26 of foam surrounded by a fiberglass skin.

Figures 8, 9, 10, 11:
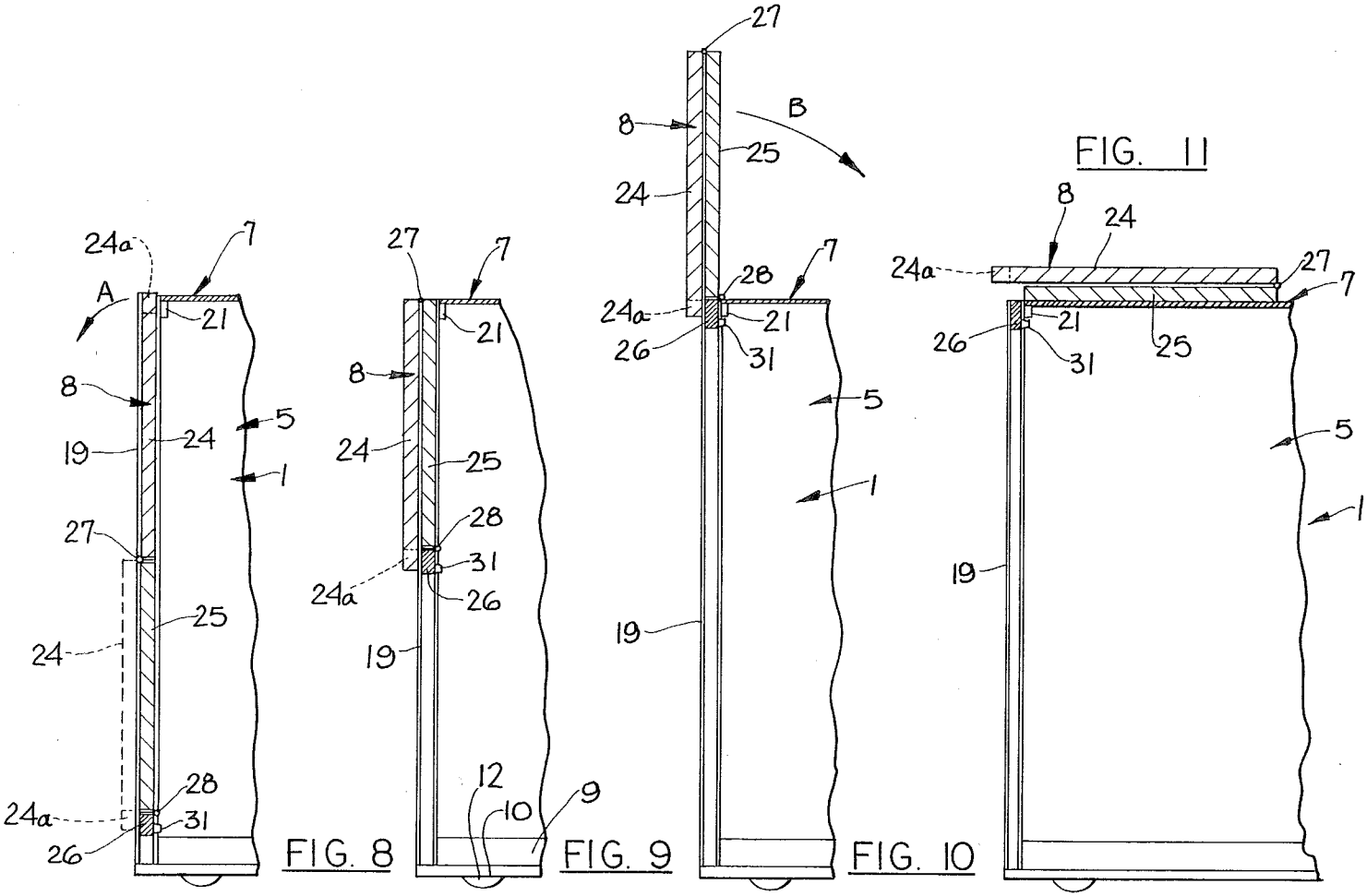
FIGS. 8–11 are fragmentary cross sectional views illustrating the various positions of the door between its fully closed position and its fully open position.

The operation of door 8 can most easily be ascertained from FIGS. 8–11. Turning first to FIG. 8, the body portion of container 1 is shown in cross section and door 8 is illustrated in its fully closed position. Intermediate panel 25 and lower panel 26 have their vertical edges engaged in channel 19 and channel 20 (not shown). Upper panel 24 has its laterally extending lug 24*a* located in channel 19. It will be understood that lateral lug 24*b* will similarly be located in channel 20 as shown in FIG. 6A.

As will be apparent from FIG. 8, the door 8 can be lifted by a sufficient amount to disengage lateral lug 24*a* from channel 19 and lateral lug 24*b* from channel 20 and the upper panel 24 can be swung forwardly in the direction of arrow A. Intermediate panel 25 and lower panel 26 can then be returned to their lowermost position, and upper panel 24 can be swung downwardly to lie in front of intermediate panel 25 and lower panel 26, as shown in broken lines in FIG. 8. Thus, the upper half of opening 18 is exposed, while its lower half will be closed by intermediate panel 25 and lower panel 26. This position of door assembly 8 will permit additional loading of container 1 when its bottom portion is already loaded, without disturbing the load in the bottom portion of the container.

To fully open the door 8, panels 24, 25 and 26 can be lifted as shown in FIG. 9 until they achieve the position shown in FIG. 10. The position of door 8 in FIG. 10 is determined by abutment of rubber door stops 31 and 32 against horizontal frame member 21. Thus, stops 31 and 32 prevent complete removal of door 8. Once the door has achieved the position shown in FIG. 10, it can be swung rearwardly in the direction of arrow B. Rearward movement of the door will continue until intermediate panel 25 lies along the top 7 of container 1 and top panel 24 lies along intermediate panel 25. This is shown in FIG. 11, wherein the door 8 is in its fully open position. To close the door 8, upper panel 24 and intermediate panel 25 are swung upwardly and forwardly in a direction opposite that of arrow B in FIG. 10 until they achieve a vertical position as shown in FIG. 10. The door 8 can then be lowered until intermediate panel and lower panel 26 achieve the position shown in FIG. 8, together with upper panel 24 as shown in broken lines. Upper panel 24 can then be swung forwardly and upwardly, in a direction opposite arrow A and the entire door assembly can be lifted slightly so that the lateral lugs **24*a* and 25*b* of upper panel 24 will clear channels 19 and 20. When properly aligned with channels 19 and 20, the door assembly can be lowered with lateral extensions 24*a* and 24*b* of upper panel 24 engaged in channels 19 and 20, respectively, at which point the door is in its fully closed position as shown in FIG. 8. It will be understood that the door 8 can be completely removed from container 1 for maintenance or repair, upon removal of stops 31 and 32 from lower panel 26**.

Figure 13:
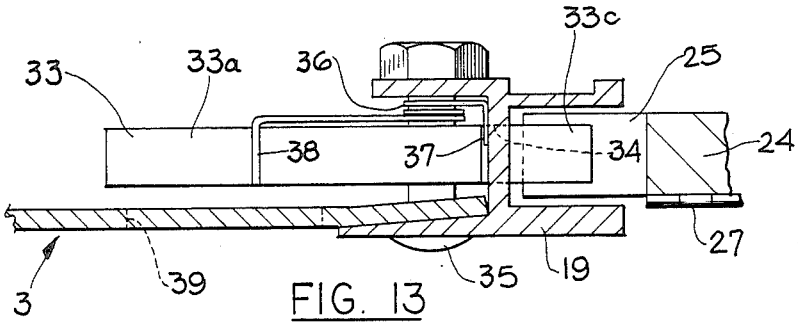
FIG. 13 is a cross sectional view taken along section line 13—13 of FIG. 12.
Figure 12:
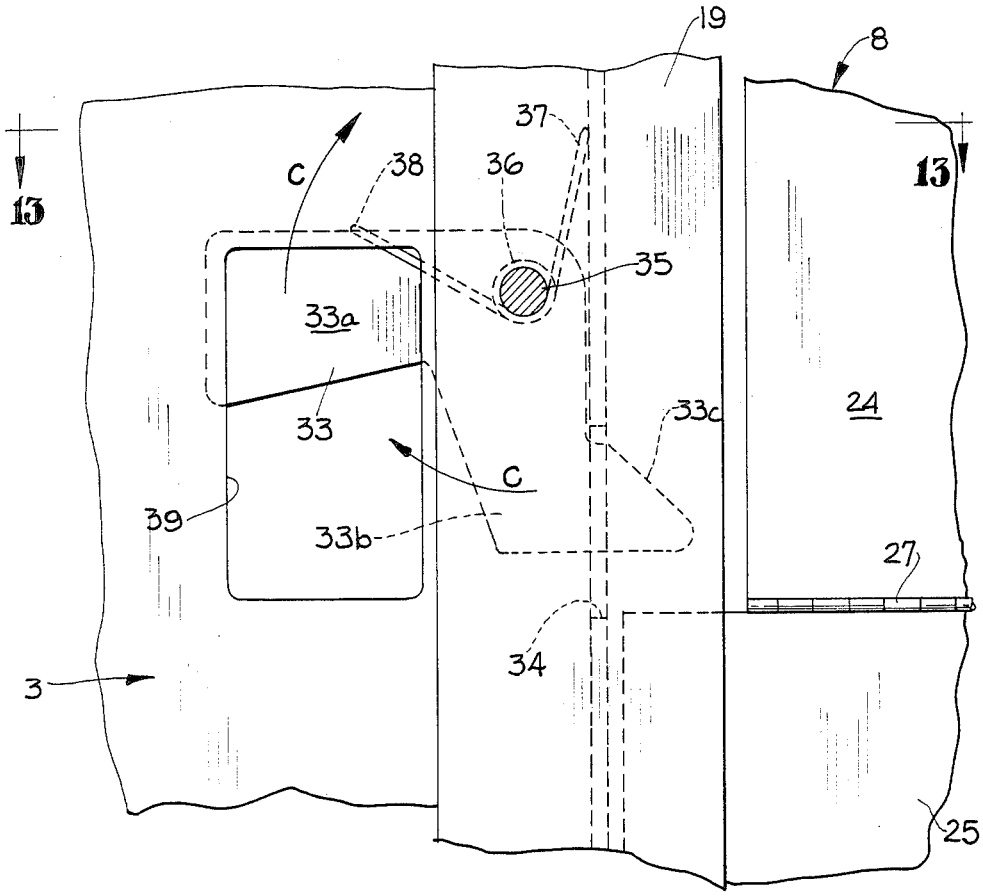
FIG. 12 is a fragmentary elevational view illustrating the door latch.

The door assembly 8 may be provided with a latch, to maintain the door in its fully closed position or in its half-closed position, both of which are shown in FIG. 8. The latch is illustrated in FIGS. 12 and 13, whereinlike parts have been given like index numerals. Again it will be noted that channel 19 is of H-shaped cross section and receives the vertical edge of intermediate panel 25 and lower panel 26 (not shown). Upper panel 24 is of a width less than the distance between channels 19 and 20, as is clearly shown in FIGS. 12 and 13.

A latch member 33 is shown in FIGS. 12 and 13. When in its normal latching position, the latch member 33 has a substantially horizontal leg **33*a*, and a substantially vertical leg 33*b*. The leg 33*b* has a nose portion 33*c* which extends through a slot or opening 34 in the web of H-shaped channel 19 and overlies the vertical edge of intermediate door panel 25 precluding upward movement of door assembly 8. The latch member 33 is pivotally attached to channel 19 by a bolt 35 extending through the legs of channel 19 and the side 3 of the container. The locking position of latch member 33 is determined by abutment of latch member leg 33*b* against the web of channel 19, as is most clearly shown in FIG. 12. The latch member 33 is biased to its latching position by spring 36 mounted on bolt 35. The spring 36 has one leg 37 which abuts the web of channel 19. The spring 36 has a second leg 38 with which engages latch member leg 33*a*. A portion of latch member leg 33*a* is exposed to the exterior of the container through a rectangular opening 39 in container side 3**.

To unlatch door assembly 8, it is only necessary to reach through opening 39 and to lift latch member leg **33*a* upwardly, causing latch member 33 to pivot about bolt 35 in a clockwise direction as viewed in FIG. 12 and as indicated by arrows C. This pivoting of latch member 33 against the action of spring 36 will retract nose 33*c* through web slot or opening 34 and thus door assembly 8 is free to be opened. When the door 8 is in the half-closed or fully closed condition, both of which are shown in FIG. 8, the latch member will return to its latching position, under the influence of spring 36**.

Figure 14:
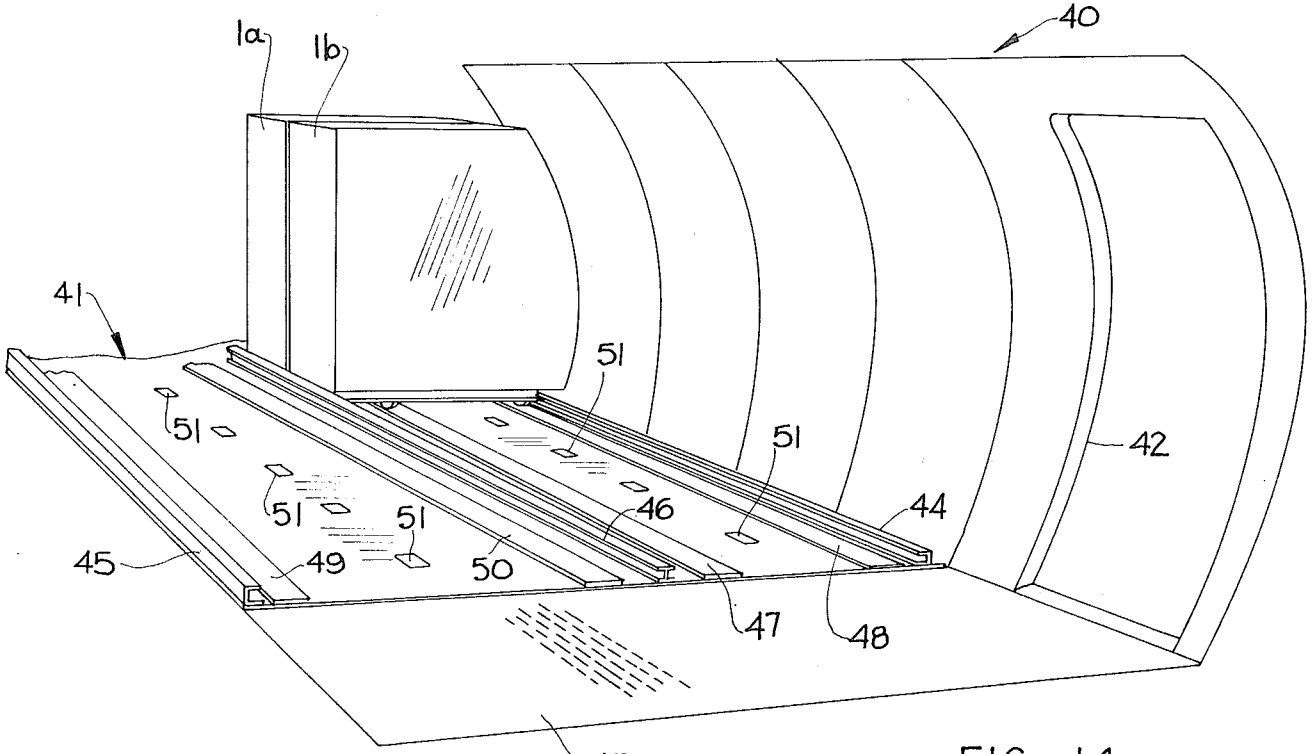
FIG. 14 is a simplified, fragment view of the aircraft fuselage cabin with a pair of containers mounted therein.

Reference is now made to FIG. 14. FIG. 14 is a fragmentary simplified view of the aircraft fuselage cabin, generally indicated at 40, provided with a floor generally indicated at 41 and a conventional left side passenger entry way 42.

At the forward loading area adjacent entry way 42 the aircraft floor may comprise an aluminum plate 43 provided with a diamond pattern or safety tread. On the left or port side of the aircraft, a guide rail 44 is provided. Similarly, a guide rail 45 is provided on the right or starboard side of the aircraft. A center guide rail assembly 46 extends longitudinally of the cargo area, down the center thereof.

The cargo area floor 41 is also provided with a pair of planks 47 and 48 for the casters of the left hand row of containers. Similarly, the floor 41 is provided with a second pair of planks 49 and 50 for the casters of the right hand row of containers. Finally, conventional fore and aft restraints are diagrammatically indicated at 51 for each row of containers. In FIG. 14, two containers **1*a* and 1*b* are illustrated in position on the left or port side of the aircraft. It will be understood that since all of the containers are preferably identical, those containers located on the left hand side of the aircraft will have their sides 3 and access openings 18 facing rearwardly. Those located in a row on the right hand side of the aircraft will have their sides 3** and access openings facing forwardly of the aircraft.

Figure 15:
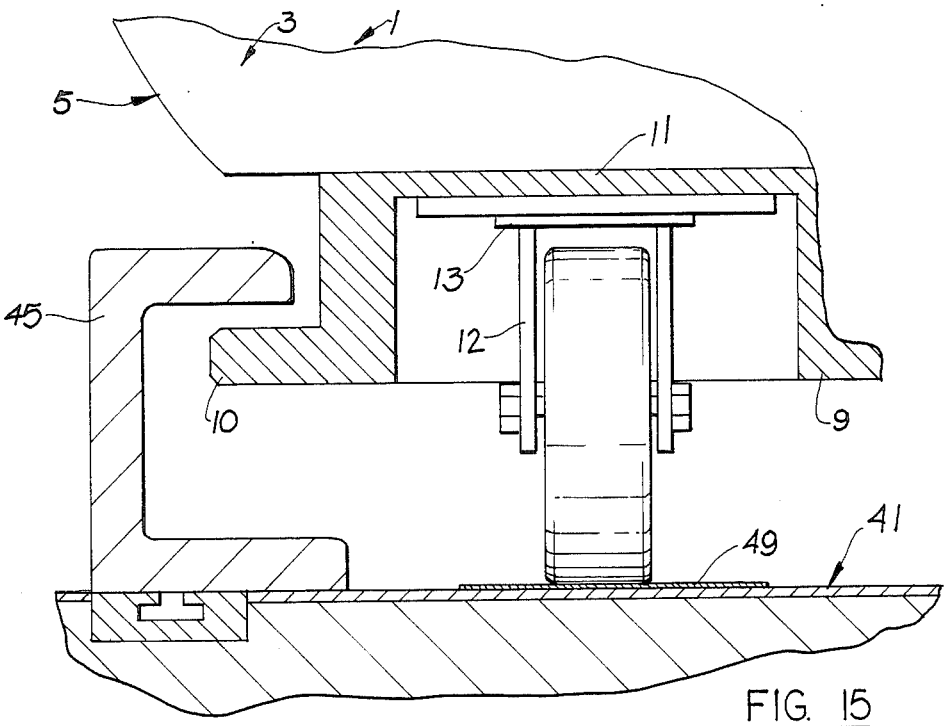
FIG. 15 is a fragmentary cross sectional view illustrating a side guide rail and cooperating container flange.
Figure 16:
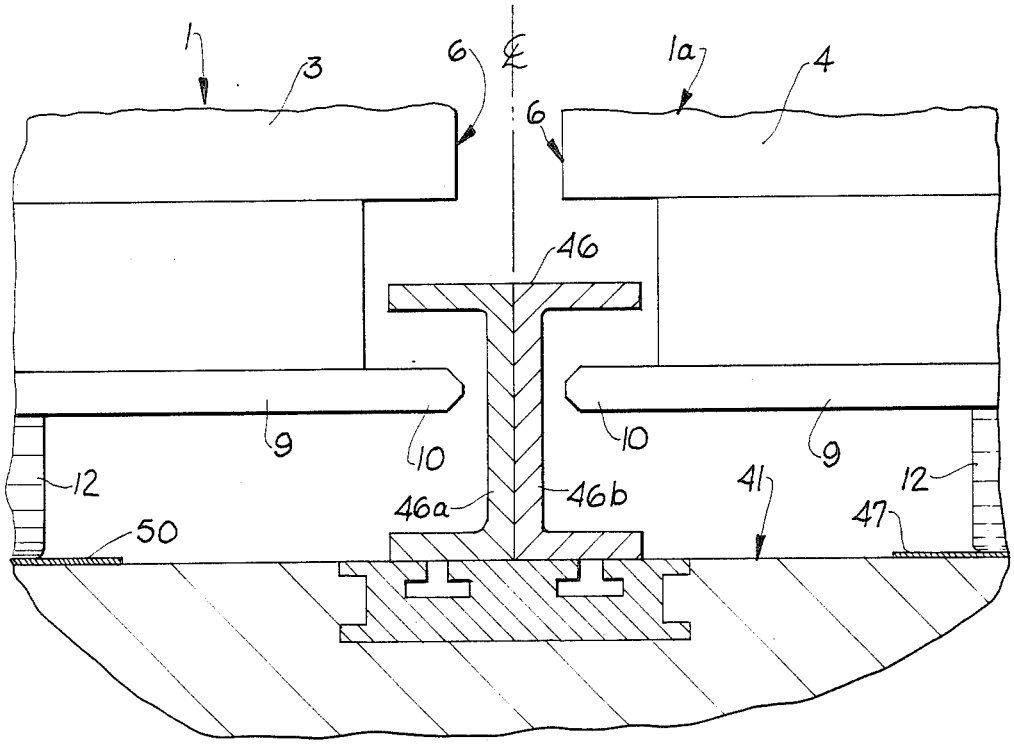
FIG. 16 is a fragmentary cross sectional view illustrating the center rail assembly and cooperating flanges on adjacent containers.

FIG. 15 is a fragmentary view of a container 1 located on the right hand side of the aircraft. FIG. 15 illustrates the manner in which that portion of the container base frame flange 10, extending along container outboard end 5, cooperates with the right hand guide rail 45. FIG. 16 illustrates the center guide rail assembly 46. The center guide rail assembly is made up of two channel-shaped rail elements **46*a* and 46*b*, in back-to-back relationship. It will be evident from FIG. 16 how that portion of the base frame flange 10, extending along the inboard end 6 of container 1 cooperates with center guide rail element 46*a*. A second container 1*a* is illustrated in FIG. 16, located on the left hand side of the aircraft. It will be apparent how that portion of its base frame flange 10, extending along its inboard side 6, cooperates with the center rail assembly element 46*b***.

Figure 17:
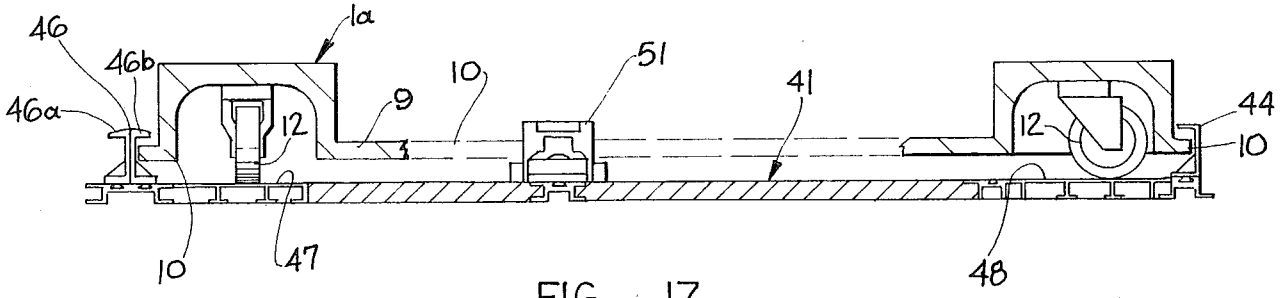
FIG. 17 is a cross sectional view of a container base illustrating its cooperation with the adjacent side guide rail and the center rail assembly, together with an end restraint.

FIG. 17 illustrates the entire frame 9 of a container **1*a* located on the left hand side of the aircraft. Again it is clearly shown how the frame flange 10 cooperates with the element 46*b* of center guide rail 46 and the left or port side guide rail 44. The base frame flange 10 also cooperates with fore and aft restraint 51**.

Figure 18:
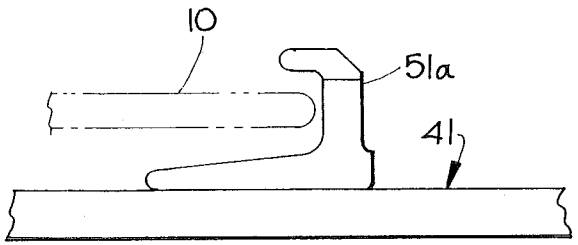
FIG. 18 is a fragmentary, simplified elevational view of a fixed restraint.

As indicated above, the fore and aft restraints 51 are conventional. Such restraints are illustrated in FIGS. 18 and 19. FIG. 18 illustrates a rigid-type restraint and the manner in which it cooperates with a container base frame flange 10. A rigid restraint of this type, facing forwardly of the aircraft, will be located at the rearwardmost end of each of the right hand and left hand rows of containers.

Figure 19:
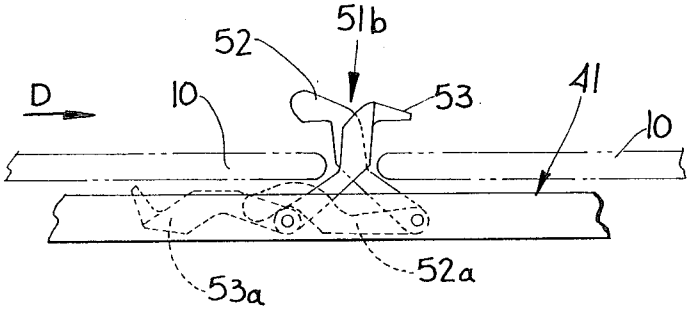
FIG. 19 is a simplified elevational view of a retractable restraint.

It will be understood that the remaining restraints in each row must be of the retractable type, capable of having a retracted position within floor 41 to enable the containers to roll thereover while being located in the right and left hand rows thereof. Such a retractable fore and aft restraint is illustrated in FIG. 19. The restraint, generally indicated at 51*b* comprises two restraint elements 52 and 53. Restraint element 52 faces toward the forward end of the aircraft and restraint element 53 faces toward the rearward end of the aircraft. Restraint element 52 has a retracted position shown at 52*a* in broken lines. Restraint element 53 has a retracted position shown at 53*a* in broken lines. When in their extended position, as shown in solid lines, the restraints 52 and 53 are locked in position by over-center linkage (not shown), as is well known in the art.

As the containers of a row are shoved toward the rearward end of the aircraft in the direction of arrow D, they will pass over restraint elements 52 and 53 in their retracted positions. When the row is filled to a point adjacent restraint 51*b*, the restraint elements 52 and 53 will be shifted to their extended, working positions (as shown in full lines), and the loading of the row will continue.

Since the containers of the present invention can be utilized on standard cargo aircraft, provided with conventional restraints, and since it takes six containers of the present invention to equal one standard pallet or container, it will be understood that the fore and aft restraints 51*b* will be located between groups of three containers of the present invention in each row. Thus, as the containers of the present invention are loaded in the aircraft, they will be guided and restrained from side-to-side by center rail assembly 46 and one of the side rails 44 and 45. The fore and aft restraints will preclude shifting of the containers in a longitudinal direction within the aircraft.

Figure 20:
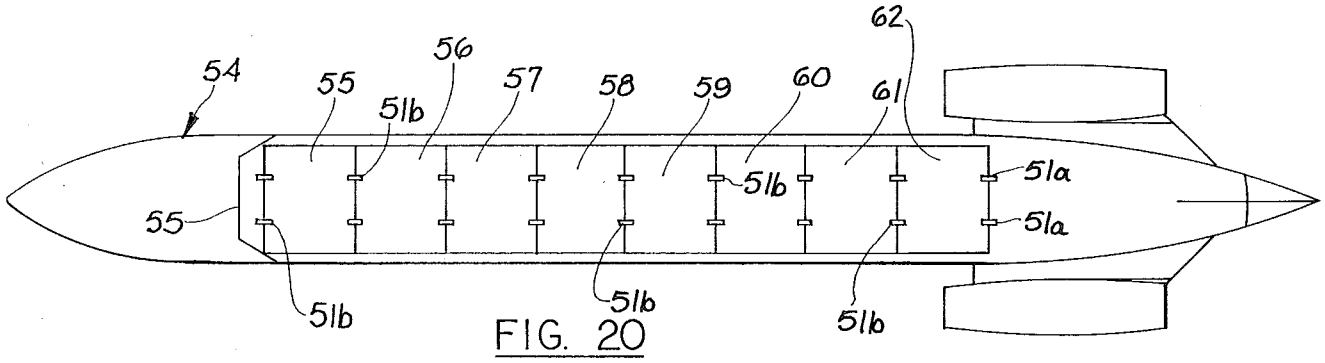
FIG. 20 is a diagrammatic representation of a DC-9 freight aircraft provided with conventional pallets or containers.

FIG. 20 is a diagrammatic representation of a DC-9 freight aircraft. The aircraft is generally indicated at 54. The aircraft is shown loaded with eight conventional pallets or containers 55–62. Rigid restraints 51*a* are illustrated at the rearward end of the aircraft, together with retractable restraints 51*b* located between each pallet or container and at the forward end of the aircraft. A barrier or net 55, capable of withstanding a 9 g force is located just ahead of the row of containers or pallets.

Figure 21:
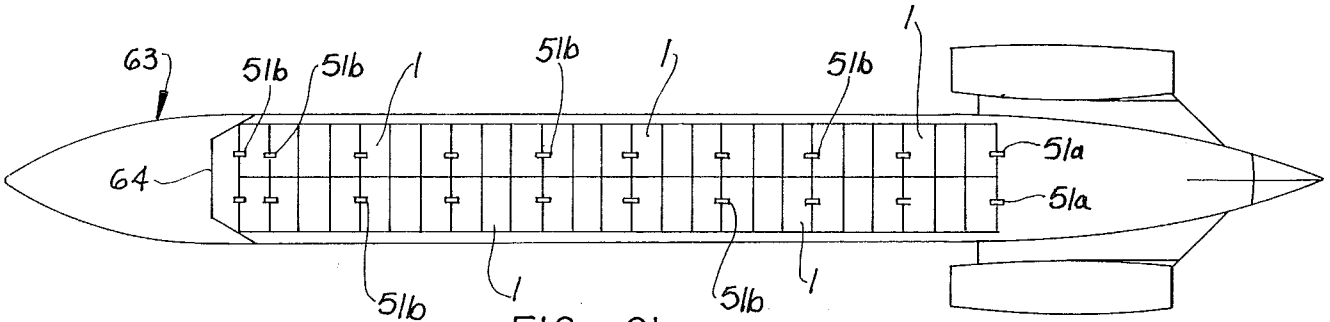
FIG. 21 is a diagrammatic representation of a DC-9 freight aircraft or converted passenger aircraft provided with containers of the present invention.

FIG. 21 illustrates diagrammatically a DC-9 freight or converted passenger aircraft, generally indicated at 63. Aircraft 63, if a converted passenger aircraft, will be similar to aircraft 54, differing primarily in that it will have a conventional passenger entry door rather than a large cargo door. Aircraft 63 of FIG. 21 is illustrated as containing two rows of containers of the present invention. A total of 50 such containers are shown. Rigid restraints 51*a* are located at the rearward end of the aircraft in the same manner as shown in FIG. 20. Retractable restraints 51*b* are provided, in the same positions shown in FIG. 20. Since it takes six containers of the present invention to equal one conventional container or pallet of the type shown in FIG. 20, the retractable restraints are located between each group of three containers in each row in FIG. 21. An additional pair of fore and aft retractable restraints are located at the forwardmost end of the rows, to restrain the forwardmost container of each row. Finally, the aircraft is provided with a barrier or net 64, identical to barrier or net 55 of FIG. 20.

Figure 22:
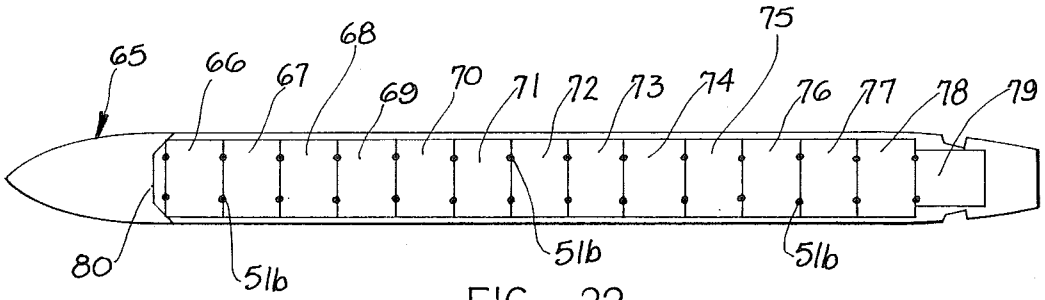
FIG. 22 is a diagram illustrating a DC-8 freight aircraft provided with conventional pallets or containers.

FIG. 22 is a diagrammatic representation of the fuselage of a DC-8 cargo aircraft, generally indicated at 65. The aircraft is illustrated as having a load of 14 standard pallets or containers 66–79. The fixed and retractable restraints will be arranged similarly to those illustrated in FIG. 20, except for the rearward-most pallet or container 79 which can be properly restrained in any well known conventional manner. The aircraft is provided with a barrier or net 80 serving the same purpose as barrier or net 55 of FIG. 20.

Figure 23:
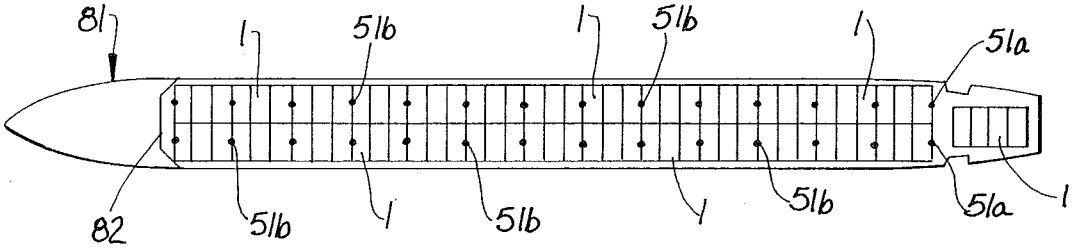
FIG. 23 is a diagrammatic representation of a DC-8 freight aircraft or converted passenger aircraft provided with containers of the present invention.

FIG. 23 illustrates diagrammatically the fuselage of a DC-8 cargo or converted passenger aircraft. The aircraft is generally indicated at 81. If aircraft 81 of FIG. 23 is a converted passenger aircraft, it will be dimensionally similar to aircraft 65 of FIG. 22, but will not be provided with an oversize cargo door. In FIG. 23, aircraft 81 is illustrated as being loaded with 82 containers 1 of the present invention. It will again be understood that the rigid and retracted restraints will be arranged in a manner similar to that shown in FIG. 21, except for the rearwardmost four containers, which can be restrained in any suitable, conventional manner. Again, aircraft 81 is provided with a net or barrier 82 serving the same purpose as net or barrier 80 of FIG. 22. A comparison of FIGS. 22 and 23 will show clearly that six containers 1 of the present invention occupy the same space as a single pallet or container.

It will be understood by one skilled in the art that the dimensions of the container of the present invention can be varied, depending upon the aircraft with which it is to be used. In an exemplary design intended for use with a converted DC-9 passenger aircraft, the container has a total height of 68 inches from the bottom of its caster wheels to its top, and the ends have a maximum width of 29.3 inches, to allow passage of the container through the standard forward left hand passenger entry door. The container has an empty weight of about 105 pounds with a design load capacity of about 1000 pounds and a minimum of about 60 cubic feet of useable internal volume. The container side walls have a maximum deflection of less than $\frac{1}{4}$ inch and the container base has a maximum deflection of 3/16 inch. The caster wheels have a diameter of 4 inches with a minimum wheel width contact surface of $1\frac{3}{8}$ inches. The container door opening is 38 inches wide and the container door has a maximum deflection of $\frac{1}{8}$ inch. The container curvature of its outboard end conforms to the curvature of the fuselage cross section with a clearance between the container and the fuselage of from about 2 inches to about $2\frac{1}{4}$ inches. The space between the inboard ends of adjacent containers is from about $\frac{1}{2}$ inch to about 9/16 inch.

It will be understood that the above described embodiment is exemplary only and, as previously stated, the dimensions and capacities can vary, depending upon the aircraft with which the container is to be used.

Modifications may be made in the invention without departing from the spirit of it.

What is claimed:

1. An aircraft cargo container having two sides, an inboard end, an outboard end, a horizontal top and a horizontal bottom, said inboard end and both sides being substantially vertical, said outboard end being curved from said top to said bottom and substantially conforming to the curvature of the cabin side wall of an aircract fuselage, said inboard and outboard ends of said container being so dimensioned as to pass freely through an aircraft standard left side passenger door, said container sides being so dimensioned that when two such containers are located within an aircraft fuselage cabin extending end-to-end transversely thereof with their inboard ends opposed they will substantially fill the interior cross-section of the aircraft fuselage cabin with clearance between themselves and between themselves and the aircraft fuselage, a loading opening formed in one of said container sides, and a door therefor.

2. The cargo container claimed in claim 1 wherein said bottom comprises a rectangular frame, said frame having a housing in each corner thereof, a caster mounted in recessed fashion in each of said housings, a bottom panel mounted on and supported by said frame, said side walls and said inboard and outboard end walls being affixed to and supported by said frame.

3. The cargo container claimed in claim 1 wherein said top, said side walls and said inboard and outboard ends comprise an integral, one-piece body molded of plastic material.

4. The cargo container claimed in claim 2 including a peripheral flange on said frame said flange extending along said container sides and inboard and outboard ends.

5. The cargo container claimed in claim 2 wherein said frame is made of aluminum and said bottom panel comprises a balsa wood core sealed in a fiberglass skin.

6. The cargo container claimed in claim 2 wherein said top, said sidewalls and said inboard and outboard ends comprise an integral, one-piece body molded of plastic material.

7. An aircraft cargo container having two sides, an inboard end, an outboard end, a horizontal top and a horizontal bottom, said inboard end and both sides being substantially vertical, said outboard end being curved from said top to said bottom and substantially conforming to the curvature of the cabin side wall of an aircraft fuselage, said inboard and outboard ends of said container being so dimensioned as to pass freely through an aircraft standard left side passenger door, said container sides being so dimensioned that when two such containers are located within an aircraft fuselage cabin extending end-to-end transversely thereof with their inboard ends opposed they will substantially fill the interior cross-section of the aircraft fuselage cabin with clearance between themselves and between themselves and the aircraft fuselage, a loading opening formed in one of said container sides and a door therefor, said loading opening being rectangular and extending substantially from said bottom to said top, vertical channel members being affixed to said one side wall defining vertical edges of said loading opening, said door comprising an upper panel, an intermediate panel and a lower panel, said panels being rectangular and having side, top and bottom edges, the bottom edge of said upper panel being hingedly affixed to the top edge of said intermediate panel, the bottom edge of said intermediate panel being hingedly affixed to the top edge of said lower panel, said upper panel having a vertical height dimension from its bottom edge to its top edge approximating one half of the vertical height of said loading opening, said intermediate panel and said lower panel having a combined vertical height dimension from said bottom edge of said lower panel to said top edge of said intermediate panel approximating said vertical height dimension of said upper panel, the vertical height dimension of said lower panel from its bottom edge to its top edge being a small fraction of the vertical height of said intermediate panel from its bottom edge to its top edge, said intermediate and lower panels being of a width from side edge to side edge such that their side adges ae slidably received in said channels, said upper panel being of a width from side edge to side edge such that its side edges just clear said channels, said upper panel having adjacent its top edge a lug extending laterally from each of its side edges and slidably receivable in said channels, said door being shiftable from a fully closed position with the side edges of said lower and itnermediate panels and said upper panel lugs in said channels, to a partially closed position with said lower and intermediate panels in the same positions they occupy in said fully closed position and said upper panel, with its lugs removed from said channels, folded downwardly to a position parallel to and in front of said intermediate and lower panels, to a fully open position with said lower panel at the upper end of said opening with its side edges in the upper ends of said channels, said intermediate panel with its side edges out of said channels, said intermediate panel being folded along and supported by said cargo container top and said upper panel folded along and lying against said intermediate panel.

8. The cargo container claimed in claim 7 wherein said door upper, intermediate, and lower panels each comprise a foam core with a fiberglass skin.

9. The cargo container claimed in claim 7 including latch means for said door, said latch means being pivotally affixed to said one side of said container, said latch means having a nose portion, said latch means being pivotable between a normal latching position wherein said latch nose portion extends through a slot in one of said channels and engages said top edge of said intermediate panel when said door is in said fully or partially closed positions and an unlatching position wherein said latch nose portion is withdrawn from said channel slot, and means to bias said latch means to said latching position.

10. The cargo container claimed in claim 9 including a peripheral flange on said frame, said flange extending along said container sides and inboard and outboard ends.

11. The cargo container claimed in claim 10 including latch means for said door, said latch means being pivotally affixed to said one side of said container, said latch means having a nose portion, said latch means being pivotable between a normal latching position wherein said latch nose portion extends through a slot in one of said channels and engages said upper edge of said intermediate panel when said door is in said fully or partially closed positions and an unlatching position wherein said latch nose portion is withdrawn from said channel slot, and means to bias said latch means to said latching position.

12. An aircraft cargo container system comprising a plurality of identical cargo containers, each cargo container having two sides, an inboard end, an outboard end, a horizontal top and a horizontal bottom, said inboard end and both sides being substantially vertical, said outboard end being curved from said top to said bottom and substantially conforming to the curvature of the cabin side wall of an aircraft fuselage, said inboard and outboard ends of said container being so dimensioned as to pass freely through an aircraft standard left side passenger door, said container sides being so dimensioned that when two such containers are located within an aircraft fuselage cabin extending end-to-end transversely thereof with their inboard ends opposed they will substantially fill the interior cross-section of the aircraft fuselage cabin with clearance between themselves and between themselves and the aircraft fuselage, a loading opening formed in one of said container sides, and a door therefor, said container bottom being rectangular, a caster being rotatively mounted at each corner of said bottom, a peripheral flange extending from and about said bottom along said sides and said inboard and outboard ends of said container, said system further including a pair of side rails each mountable on the floor along the side of an aircraft fusalage cabin and each having an inwardly extending lateral flange along the length thereof, and a center rail mountable on the aircraft floor intermediate and parallel to said side rails and having oppositely directed lateral flanges along the length thereof, said containers being locatable in said fusalage cabin in first and second longtiduinal rows, said containers being in side-to-side relationship within each row and with the inboard ends of the containers of said first longitudinal row opposed to the inboard ends of the containers of said second longitudinal row, that portion of said bottom flange extending along said outboard end of each container cooperating with said flange of the adjacent one of said side rails, and that portion of said bottom flange extending along said inboard end of each container cooperating with the adjacent one of said lateral flanges of said center rail.

13. The system claimed in claim 12 wherein said bottom flange portions extending along said sides of at least selected ones of said containers are engagable by conventional fore and aft restraints.

14. An aircraft cargo container having two sides, an inboard end, an outboard end, a horizontal top and a horizontal bottom, said inboard end and both sides being substantially vertical, said outboard end being curved from said top to said bottom and substantially conforming to the curvature of the cabin side wall of an aircraft fuselage, said bottom comprising a rectangular frame, said frame having a housing in each corner thereof, a caster mounted in recessed fashion in each of said housings, a bottom panel mounted on and supported by said frame, said side walls and said inboard and outboard end walls being affixed to and supported by said frames aid top, said sidewalls and said inboard and outboard ends comprise an integral, one-piece body molded of plastic material, said inboard and outboard ends of said container being so dimensioned as to pass freely through an aircraft standard left side passenger door, said container sides being so dimensioned that when two such containers are located within an aircraft fuselage cabin extending end-to-end transversely thereof with their inboard ends opposed they will substantially fill the interior cross-section of the aircraft fuselage cabin with clearance between themselves and between themselves and the aircraft fuselage, a loading opening formed in one of said container sides, and a door thereof, said loading opening being rectangular and extending substantially from said bottom to said top, vertical channel members being affixed to said one side wall defining vertical edges of said loading opening, said door comprising an upper panel, an intermediate panel and a lower panel, said panels being rectangular and having side, top and bottom edges, the bottom edge of said upper panel being hingedly affixed to the top edge of said intermediate panel, the bottom edge of said intermediate panel being hingedly affixed to the top edge of said lower panel, said upper panel having a vertical height dimension from its bottom edge to its top edge approximating one half of the vertical height of said loading opening, said intermediate panel and said lower panel having a combined vertical height dimension from said bottom edge of said lower panel to said top edge of said intermediate panel approximating said vertical height dimension of said upper panel, the vertical height dimension of said lower panel from its bottom edge to its top edge being a small fraction of the vertical height of said intermediate panel from its bottom edge to its top edge, said intermediate and lower panels being of a width from side edge to said edge such that their side edges are slidably received in said channels, said upper panel being of a width from side edge to side edge such that its side edges just clear said channels, said upper panel having adjacent its upper edge a lug extending laterally from each of its side edges and slidably receivable in said channels, said door being shiftable from a fully closed position with the side edges of said lower and intermediate panels and said upper panel lugs in said channels, to a partially closed position with said lower and intermediate panels in the same positions they occupy in said fully closed position and said upper panel, with its lugs removed from said channels, folded downwardly to a position parallel to and in front of said intermediate and lower panels, to a fully open positon with said lower panel at the upper end of said opening with its side edges in the upper ends of said channels, said intermediate panel with its side edges out of said channels, said intermediate panel being folded along and supported by said cargo container top and siad upper panel folded along and lying against said intermediate panel.

* * * * *